US005651412A

United States Patent [19]

Williams et al.

[11] Patent Number: 5,651,412

[45] Date of Patent: Jul. 29, 1997

[54] STRIP CASTING WITH FLUXING AGENT APPLIED TO CASTING ROLL

[75] Inventors: Robert S. Williams, Fairfield; Ronald J. O'Malley, Miamisburg; Richard C. Sussman, West Chester, all of Ohio

[73] Assignee: Armco Inc., Middletown, Ohio

[21] Appl. No.: 540,370

[22] Filed: Oct. 6, 1995

[51] Int. Cl.[6] ..... B22D 11/06

[52] U.S. Cl. ..... 164/479; 164/268; 164/480

[58] Field of Search ..... 164/463, 472, 164/480, 72, 428, 268, 423, 429, 479, 149; 148/26; 75/305, 307, 309, 313

[56] References Cited

U.S. PATENT DOCUMENTS

| | | | |
|---|---|---|---|
| 2,467,544 | 4/1949 | Whitcomb | 148/26 X |
| 2,719,800 | 10/1955 | Veltri | 148/26 |
| 2,720,473 | 10/1955 | Donahey | 148/26 |
| 3,175,933 | 3/1965 | Wasserman et al. | 148/26 |
| 3,179,540 | 4/1965 | Asinovskaja et al. | 148/26 |
| 3,490,942 | 1/1970 | Lalieu | 148/26 X |
| 3,685,986 | 8/1972 | Rutes et al. | 164/472 X |
| 3,941,537 | 3/1976 | Abraham | 164/149 X |
| 3,983,889 | 10/1976 | Thym et al. | 134/9 |
| 5,103,895 | 4/1992 | Furuya et al. | 164/480 X |
| 5,219,114 | 6/1993 | Kajiwara et al. | 228/158 |

FOREIGN PATENT DOCUMENTS

| | | |
|---|---|---|
| 234241 | 3/1986 | Germany . |
| 234240 | 3/1986 | Germany . |
| 53-7532 | 1/1978 | Japan . |
| 58-61953 | 4/1983 | Japan . |
| 58-179543 | 10/1983 | Japan . |
| 61-30267 | 2/1986 | Japan . |
| 63-207452 | 8/1988 | Japan . |
| 1-118344 | 5/1989 | Japan . |
| 3-66454 | 3/1991 | Japan . |

*Primary Examiner*—J. Reed Batten, Jr.
*Attorney, Agent, or Firm*—R. J. Bunyard; L. A. Fillnow

[57] ABSTRACT

A strip caster (10) for producing a continuous strip (24) includes a tundish (12) for containing a melt (14), a pair of horizontally disposed water cooled casting rolls (22) and devices (29) for electrostatically coating the outer peripheral chill surfaces (44) of the casting rolls with a powder flux material (56). The casting rolls are juxtaposed relative to one another for forming a pouting basin (18) for receiving the melt through a teeming tube (16) thereby establishing a meniscus (20) between the rolls for forming the strip. The melt is protected from the outside air by a non-oxidizing gas passed through a supply line (28) to a sealing chamber (26). A preferred flux is boron oxide having a melting point of about 550° C. The flux coating enhances wetting of the steel melt to the casting roll and dissolves any metal oxide formed on the roll.

14 Claims, 3 Drawing Sheets

STRIP CASTING WITH FLUXING AGENT APPLIED TO CASTING ROLL

The Government of the United States of America has rights in this invention pursuant to Contract No. DE-FC07-92ID13086 awarded by the U.S. Department of Energy.

BACKGROUND OF THE INVENTION

This invention relates to a method for casting a metal melt into a continuous metal strip. More particularly, the invention relates to coating the peripheral chill surface of a casting roll with a fluxing agent. The flux coating enhances wetting of the melt to the casting roll and minimizes metal oxide formation on the chill surface during casting of the metal strip.

Direct strip casting involves bringing a melt into contact with a water cooled metal substrate such as a chill surface of a casting roll. This generally is accomplished by casting the melt onto a single casting roll rotating past a refractory pouring nozzle or by pouring the melt into the meniscus formed between a pair of opposing rotating casting rolls. Intimate contact of solidifying metal to a bare metal substrate is required to achieve a high cooling rate. As the solidified metal strip cools while still in contact with the chill surface of the casting roll, the strip contracts. This contraction results in very high tensile stresses due to constraint from the substrate. If adhesion of the strip to the chill surface is too high, the strip may crack. If the adhesion is too low, the strip can lift-off from the chill surface causing a dramatic decrease in the heat transfer rate. This lifting-off can lower the solidification rate and decrease the thickness of the strip. If the lifting-off occurs only in certain portions of the chill surface with intervening areas having good contact, the lifted-off portions experience high tensile stress while those portions of the strip having good adhesion cool more quickly. This differential cooling may result in non-uniform thickness and hot tearing of the strip.

During casting, elements and oxides in the molten metal deposit onto the chill surface as an oxide film. As the thickness of this oxide film increases, the heat transfer rate decreases thereby lowering the solidification rate. This oxide film may also cause gas evolution resulting in porosity in the cast metal strip. This oxide film is tenaciously bonded to the chill surface and difficult to remove by mechanical means such as brushes, buffer wheels, grinding wheels and flapper type disks. These mechanical devices also degrade the chill surface because of uneven wear and tend to vibrate the casting roll thereby disrupting the meniscus.

It is known to condition the peripheral chill surface of a casting roll to prevent strip surface cracks and strip surface quality deterioration due to surface irregularities caused by metal oxide formation. U.S. Pat. No. 5,103,895 relates to twin roll casting of metal strip and discloses copper casting rolls having their chill surfaces electroplated with nickel. Dimples are formed on the chill surfaces. A soluble gas is supplied to the meniscus area between the rolls where the melt comes into contact with the opposing chill surfaces. Gas becomes trapped within the dimples and prevents metal oxide formation on the chill surface. After strip is withdrawn from between the rolls, the chill surfaces of the rolls are cleaned by brushing. Thereafter, the cleaned chill surfaces are roll coated with zircon or alumina to improve the quality of the cast metal strip and to prolong the service life of the casting rolls.

Nevertheless, there remains a need for enhancing wetting of a metal melt to a casting roll and to minimize metal oxide formation on the casting roll during casting of a metal strip. There remains a further need for enhancing wetting of the melt and minimizing oxide formation without leaving grinding lines or gouges on the casting roll and without vibrating the casting roll during casting of the metal strip. Still further, there is a need to provide a layer of relatively low viscosity material which can provide a slip plane between the solidified strip and the casting roll while still maintaining a relatively high heat transfer condition. There is a need to moderate the extremely high rates of heat transfer which can occur at areas of intimate metal-to-metal contact to promote a more uniform overall heat transfer rate. Additional time at elevated temperature also is needed for the solidified strip to mechanically relax in order to prevent the buildup of shrinking stresses.

BRIEF SUMMARY OF THE INVENTION

A principal object of the invention is to prevent crack formation in the surface of cast metal strip.

Another object of the invention is to form cast metal strip having uniform thickness.

Another object of the invention is to have a uniform heat transfer rate across the width of a solidifying metal strip and the chill surface of a casting roll.

Other objects include minimizing metal oxide formation to improve wetting of molten metal to the surface of the casting roll thereby providing uniform strip adhesion across the width of the roll surface and elimination of vibration to the casting roll, provide a slip plane between the solidified strip and the casting roll while still maintaining a relatively high heat transfer condition, moderate the extremely high rates of heat transfer which can occur at areas of intimate metal-to-metal contact and prevent the buildup of shrinking stresses in the as-cast strip.

The invention relates to a method of enhancing wetting of a metal melt to a casting roll and minimizes metal oxide formation on the casting roll during casting of a continuous metal strip. The invention includes the steps of providing a melt of the metal to be cast, providing a casting roll having a peripheral chill surface having a width at least as wide as the width of the strip, rotating the casting roll, coating the entire width of the chill surface with a flux having a melting point for enhancing the wettability of the chill surface by the melt, casting the melt onto the flux coated chill surface forming the strip and removing the strip from the surface of the casting roll.

Another feature of the invention is for the aforesaid flux to have a viscosity as measured at 100° C. above the melting point of the flux of less than 12μ.

Another feature of the invention is for the aforesaid flux to have a melting point of 300°–1100° C.

Another feature of the invention is for the aforesaid flux to be electrostatically coated onto the casting roll.

Another feature of the invention is to include the additional steps of surrounding the fluxed surface with a non-oxidizing atmosphere and maintaining the fluxed surface in the non-oxidizing atmosphere until the fluxed surface is wetted by the melt.

Another feature of the invention is to includes a pair of rolls for casting the strip. Advantages of the invention include improved surface quality of a metal cast strip, improved wetting of a metal melt to the peripheral surface of a casting roll, improved adhesion of the as-solidified strip to the roll surface, elimination of vibration to the casting roll, improved cleaning of metal oxide on the chill surface of the casting roll, increased casting roll life and improved strip thickness uniformity.

The above and other objects, features and advantages of the invention will become apparent upon consideration of the detailed description and appended drawings.

DETAILED DESCRIPTION OF THE PREFERRED EMBODIMENT

Figure 1:
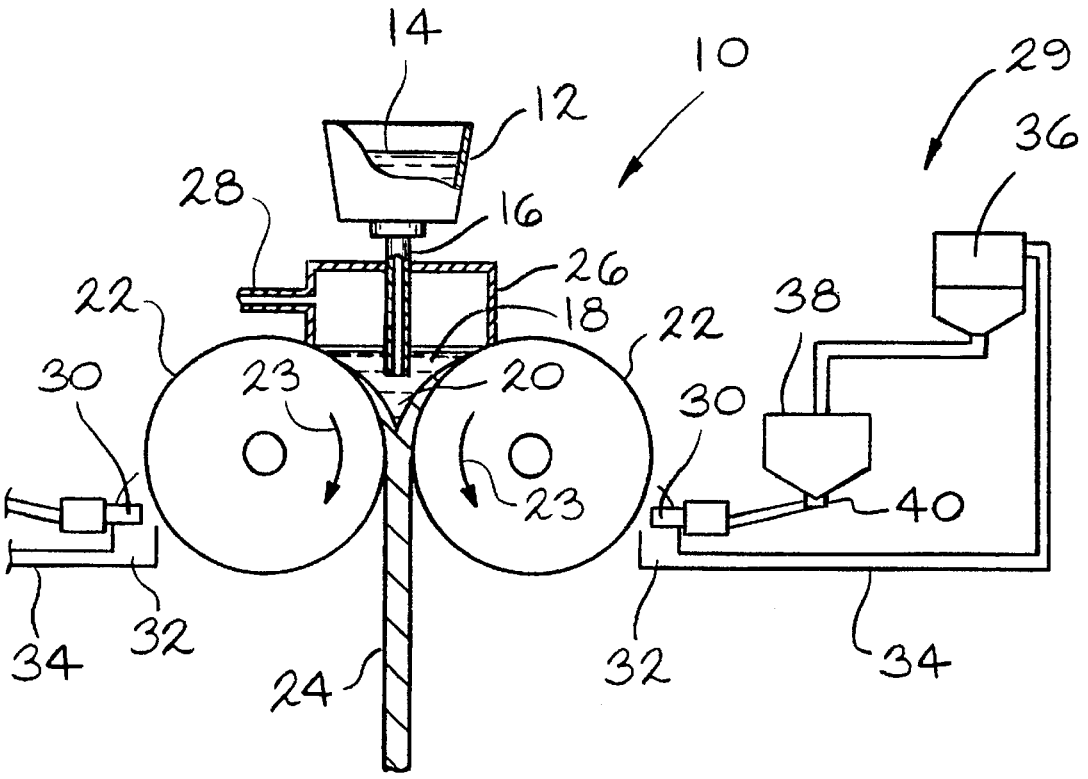
FIG. 1 is an elevation view, partially in section, of a twin roll strip caster incorporating the invention.

The invention relates to a method of enhancing wetting of a metal melt to a casting roll and minimizes metal oxide formation on the casting roll during direct casting of a continuous metal strip. Strip casting involves bringing a melt into contact with a water cooled chill surface of a casting copper roll. This may be accomplished by rotating the roll past a refractory pouring nozzle or by pouring the melt into the meniscus formed between a pair of opposing rotating casting rolls. Intimate contact of solidifying metal to a bare metal substrate is required to achieve a high cooling rate. If adhesion of the strip to the chill surface is too high, the strip may crack. If the adhesion is too low, the strip can lift-off from the chill surface causing a decrease in the heat transfer rate. It has been determined that uniform adhesion can be maintained between the cast metal strip and the casting roll if the chill surface of the casting roll is covered with a liquid flux immediately prior to wetting the chill surface with the metal melt.

During metal strip casting, the chill surface of a casting roll normally will have a temperature of at least 300° C. When casting steel, the chill surface temperature may approach 600° C. Constituents contained in the melt such as iron, magnesium, aluminum, silicon and chromium tend to form oxides which tenaciously become adhered to the chill surface of the casting roll.

A liquid flux coating can be achieved if the chill surface is covered with a powder flux material having a low melting point. For the invention, a low melting point flux is defined as having a melting point lower than the predicted temperature of the as-cast strip. It will be understood, however, the flux of this invention need not be liquid when the melt contacts the casting roll. A liquid flux coating provides excellent wetting of the metal melt to the chill surface of the casting roll, even when a relatively thin layer of a metal oxide already exists on the casting roll. A liquid flux coating also prevents any further metal oxide buildup on the casting roll. In fact, it appears a liquid flux tends to dissolve any metal oxides already present as a film on the casting roll.

Non-limiting acceptable fluxing materials for the invention include boron oxide, borax, sodium oxide, sodium carbonate, lithium oxide and fluoride containing compounds such as calcium fluoride. The viscosity as measured at 100° C. above the melting point of the flux should be 0.1–12μ (poise). Preferably, the viscosity should be 0.3–10μand more preferably between 0.8–5μ. A preferred flux is boron oxide because it has a relatively low melting point of about 550° C. and has a low viscosity. The viscosity of boron oxide as measured at 650° C. is less than 10μ. It is believed the viscosity should be less than 10μ because the flux can provide a slip plane between the solidified strip and the casting roll while still maintaining a relatively high heat transfer condition.

The continuous strip of the invention can be formed from a variety of ferrous and non-ferrous molten metals such as stainless steel, alloy steel, low carbon steel, aluminum and aluminum alloys, copper and copper alloys and amorphous metals.

Referring to FIG. 1, reference numeral 10 denotes a caster for producing a continuous metal strip. Caster 10 includes a tundish 12 for containing a metal melt 14, a pair of horizontally disposed water cooled casting rolls 22 and means (not shown) for rotating rolls 22 toward one another as indicated by arrows 23. Casting rolls 22 are juxtaposed relative to one another for forming a pouring basin 18 for receiving melt 14 thereby establishing a meniscus 20 between the rolls. Melt 14 is delivered to pouting basin 18 through a teeming tube 16. The casting rolls are water cooled and are fabricated from a highly conductive metal such as copper. To enhance heat and wear resistance of the roll surface, the chill surface of the roll normally is electroplated with an oxide resistant metal coating such as nickel. As molten metal 20 is withdrawn from between rolls 22, a solidified strip 24 is formed. Preferably, melt 14 is protected from the outside air by a non-oxidizing gas within a sealing chamber 26 through a gas supply line 28. Suitable protective gas that may be used include nitrogen, argon, helium, hydrogen, carbon monoxide, carbon dioxide and ammonia. Means 29 for coating the outer peripheral chill surfaces of casting rolls 22 with a powder flux includes one or more electrostatic nozzles 30, a collection trough 32 for gathering powder not attracted to the chill surface of the casting roll, a line 34 for recycling the powder to a bag house 36, a feeder 38 and a pressurized distributor 40 for delivering the powder to nozzle 30. It may be desirable to have more than one bag house for storing more than one type powder. For example, a second powder having a different melting point for coating the chill surface of the casting roll can be on standby ready for use. Although electrostatic coating is preferred, other possible flux coating techniques include providing a molten flux bath with the casting rolls contacting the upper surface of the bath thereby transferring liquid flux from the bath to the rolls or applying a flux coating to the casting rolls using vapor deposition.

The type strip caster illustrated in FIG. 1 is commonly referred to a twin roll or dual drum caster. It will be understood coating means 29 of the invention also could be used with a single roll caster as well. Unlike the twin roll caster of FIG. 1 wherein the strip is withdrawn from below an opposing pair of rolls, a strip is formed by being pulled over the top of the casting roll in a single roll caster.

Figure 2:
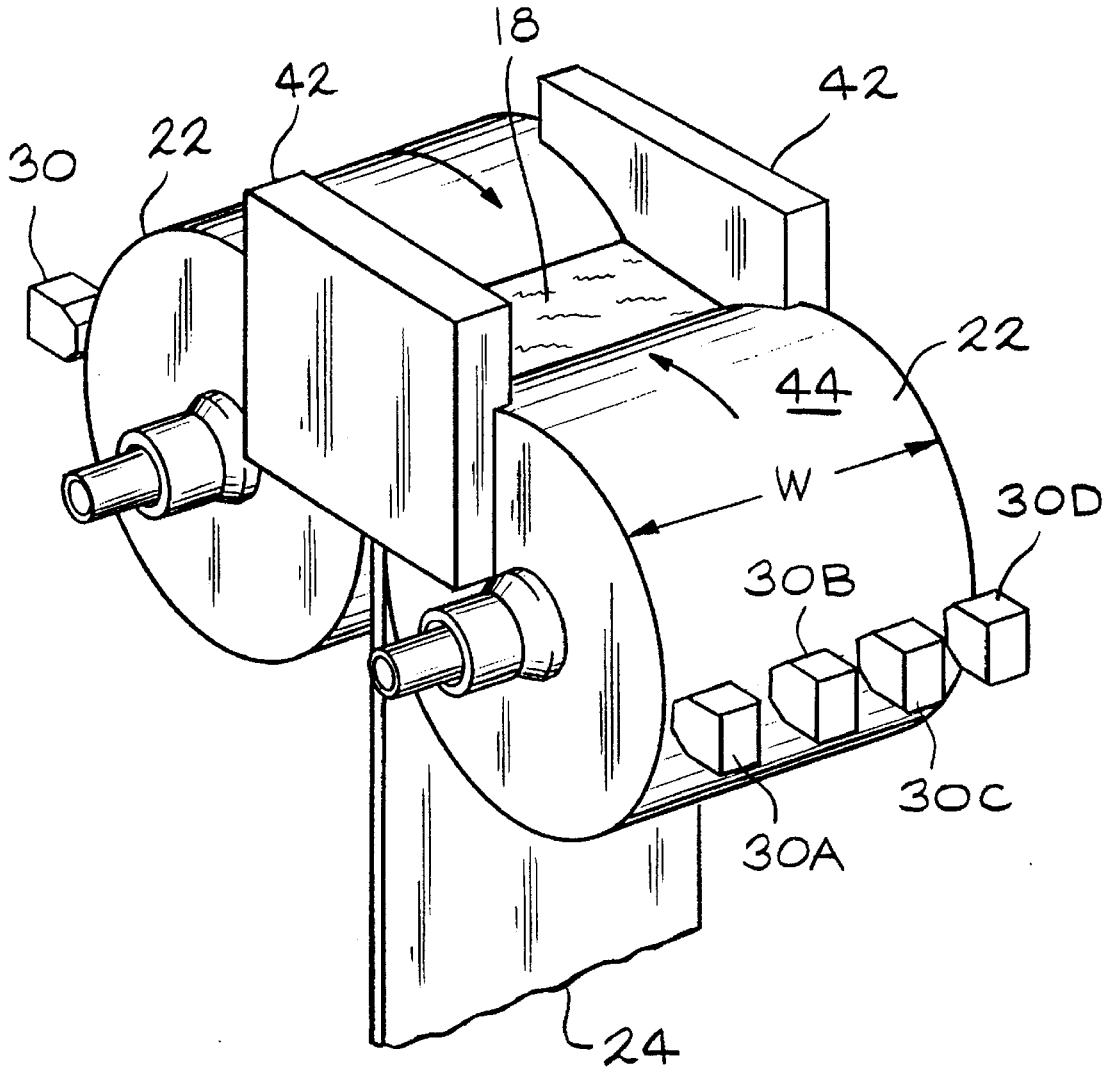
FIG. 2 is an enlarged perspective view of means for coating the chill surface of the casting roll illustrated in FIG. 1.

FIG. 2 is an enlarged view of the caster with sealing chamber 26 removed. Pouring basin 18 is formed between the meniscus between rolls 22 by a pair of side dams 42. In the embodiment illustrated, the coating means includes one row of four electrostatic spray nozzles 30A, 30B, 30C and 30D evenly spaced from one another and positioned a short distance away from a chill surface 44 of each casting roll 22. Nozzles 30A, 30B, 30C and 30D are evenly spaced across the entire width W of chill surface 44 to uniformly and completely coat the entire width with the fluxing powder.

Figure 3:
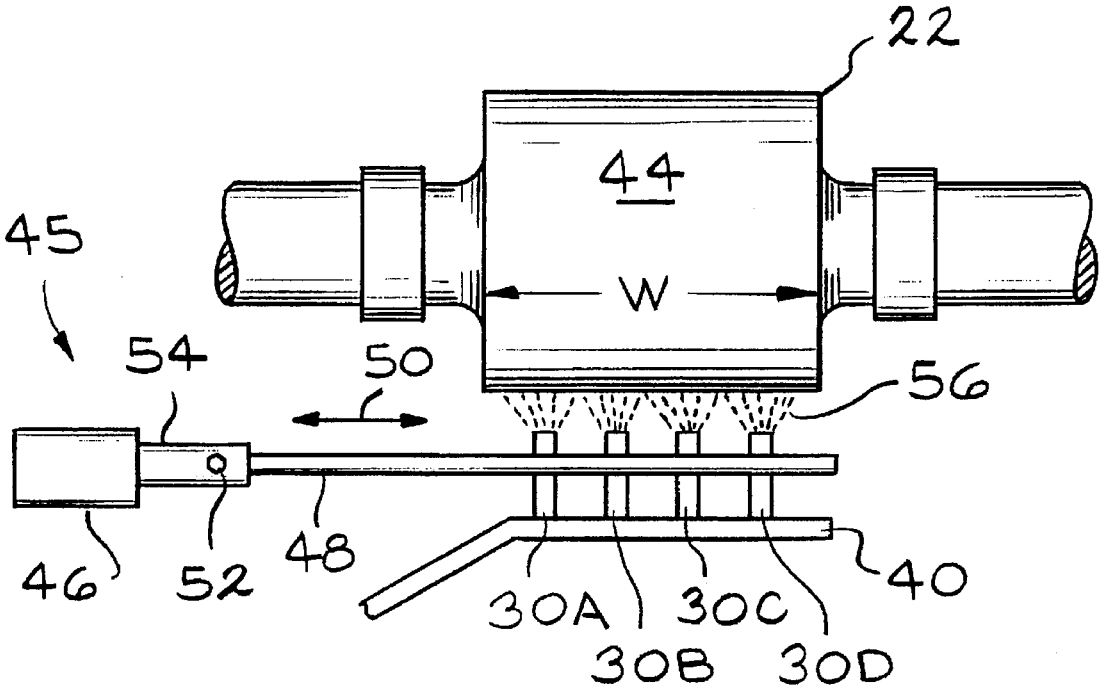
FIG. 3 is a top view illustrating details of the coating means of FIG. 2.

FIG. 3 is an enlarged view illustrating the spacing of nozzles 30A, 30B, 30C and 30D between each other and chill surface 44 of casting roll 22. In this embodiment, distributor 40 includes means 45 for traversing nozzles 30A, 30B, 30C and 30D across the width W of chill surface 44. Traversing means 45 includes an air cylinder 46, a piston 54 and a traversing arm 48 connected to the piston by a bolt 52. Nozzles 30A, 30B, 30C and 30D are mounted onto traversing arm 48. Traversing means 45 allows the nozzles to oscillate in a direction indicated by an arrow 50 to insure complete and uniform coating coverage by powder 56. Traversing means 45 also tends to even out any coating irregularity of the nozzles.

In addition to protecting the melt from atmospheric oxidation, if may also be desirable to protect flux coated surface 44 of roll 22 from oxidation from the outside air as well, particularly when casting metals such as steel. When casting steel, the chill surface temperature of the casting roll typically approaches 600° C. It may be desirable to surround the fluxed chill surface of the casting roll with a non-oxidizing atmosphere similar to those recommended for sealing chamber 26 to prevent oxide from forming on the casting roll and to reduce free oxygen gas entrapped into the flux layer.

To better understand the invention, an example now will be provided. In the laboratory, a copper casting roll having a diameter of about 610 cm and a width of about 355 cm was used to cast a low carbon steel strip having a thickness of about 1.2 mm. A conventional electrostatic spray gun was used to coat a powder sold under the trade name of Vitra Cast sold by the Chi-Vit Corporation of Downers Grove, Ill., USA. The powder had a melting temperature of about 1000° C. A powder layer was uniformly applied over the entire width of the casting roll using the spray nozzle to produce a steel strip having a uniform thickness for about one minute at a speed of about 50 m per minute. After the flux had been applied to the casting roll and the steel melt cast onto the fluxed roll, it was observed that the as-formed steel strip had consistent and uniform adhesion to the casting roll. Minimal cracks, tears and buckles or other defects were observed to be present in the surfaces of the cast steel strip. It was additionally observed that no blow hole defects were formed in the as-cast strip.

It will be understood various modifications may be made to the invention without departing from the spirit and scope of it. Therefore, the limits of the invention should be determined from the appended claims.

What is claimed is:

1. A method of casting metal into a continuous strip, comprising:

providing a melt of a metal to be cast, providing a casting roll having a peripheral chill surface having a width at least as wide as the width of the strip, a plurality of spray nozzles spaced from one another and positioned a short distance away from the chill surface and means for traversing the nozzles across the width of the chill surface, rotating the casting roll, coating the chill surface with a flux coating from the traversing nozzles for enhancing the wettability of the chill surface by the melt, the flux having a melting point, casting the melt onto the flux coated chill surface forming the continuous strip, and removing the strip from the chill surface of the casting roll.

2. The method of claim 1 wherein the melting point is 300°–1100° C.

3. The method of claim 2 wherein the melting point is no greater than 600° C.

4. The method of claim 1 wherein the flux is a powder and electrostatically coated onto the casting roll.

5. The method of claim 1 wherein the flux has a viscosity as measured at 100° C. above the melting point of the flux is less than 12μ.

6. The method of claim 5 wherein the viscosity is 0.3–10μ.

7. The method of claim 6 wherein the viscosity is 0.8–5μ.

8. The method of claim 1 wherein the flux is from the group consisting of boron oxide, borax, sodium oxide, sodium carbonate, lithium oxide and calcium fluoride.

9. The method of claim 1 including the additional steps of:

surrounding the fluxed surface with a non-oxidizing atmosphere, maintaining the fluxed surface in the non-oxidizing atmosphere until the fluxed surface is wetted by the melt.

10. The method of claim 1 wherein the flux is coated across the entire width of the casting roll.

11. The method of claim 1 including a pair of rolls for casting the strip.

12. The method of claim 4 wherein the nozzles are electrostatic spray nozzles uniformed spaced across the width of the roll surface.

13. A method of casting metal into a continuous strip, comprising:

providing a melt of a metal to be cast, providing a casting roll having a peripheral chill surface having a width at least as wide as the width of the strip, a plurality of electrostatic spray nozzles adjacent to the chill surface of the casting roll and means for traversing the nozzles across the width of the chill surface, rotating the casting roll, electrostatically coating the entire width of the chill surface with a powder flux coating from the traversing nozzles for enhancing the wettability of the chill surface by the melt, the flux having a melting point of 300°–1100° C. and a viscosity as measured at 100° C. above the melting point of the flux of less than 12μ, casting the melt onto the flux coated chill surface forming the continuous strip, and removing the strip from the chill surface of the casting roll.

14. A method of casting molten steel into a continuous steel strip, comprising:

providing a steel melt, providing a casting roll having a peripheral chill surface having a width at least as wide as the width of the strip, a plurality of electrostatic spray nozzles adjacent to the chill surface of the casting roll and means for traversing the nozzles across the width of the chill surface, rotating the casting roll, electrostatically coating the entire width of the chill surface with a powder flux coating from the traversing nozzles for enhancing the wettability of the chill surface by the melt, the flux having a melting point of 300°–600° C. and a viscosity as measured at 100° C. above the melting point of the flux of 0.3–10μ, casting the melt onto the flux coated chill surface forming the continuous strip, and removing the strip from the chill surface of the casting roll.

* * * * *